US008016553B1

(12) United States Patent
Liang

(10) Patent No.: US 8,016,553 B1
(45) Date of Patent: Sep. 13, 2011

(54) TURBINE VANE WITH RIM CAVITY SEAL

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 943 days.

(21) Appl. No.: 12/001,513

(22) Filed: Dec. 12, 2007

(51) Int. Cl.
*F01D 11/02* (2006.01)

(52) U.S. Cl. ..... 415/174.5; 415/115; 415/131; 415/211.2

(58) Field of Classification Search ..... 415/115, 415/131, 174.5, 191, 211.2
See application file for complete search history.

(56) References Cited

U.S. PATENT DOCUMENTS 1,482,031 A * 1/1924 Parsons et al. ..... 277/420
1,756,958 A * 5/1930 Schmidt ..... 415/131
1,831,224 A * 11/1931 Baumann ..... 277/418
4,344,736 A 8/1982 Williamson
4,820,116 A 4/1989 Hovan et al.
5,320,483 A 6/1994 Cunha et al.
5,340,274 A 8/1994 Cunha
5,399,065 A 3/1995 Kudo et al.
5,609,466 A 3/1997 North et al.
5,758,487 A 6/1998 Salt et al.
5,967,745 A * 10/1999 Tomita et al. ..... 415/173.7
6,099,244 A 8/2000 Tomita et al.
6,761,529 B2 7/2004 Soechting et al.
2008/0232949 A1 * 9/2008 Reichert et al. ..... 415/1

* cited by examiner

*Primary Examiner* — Ninh H Nguyen
(74) *Attorney, Agent, or Firm* — John Ryznic

(57) ABSTRACT

A turbine rim cavity seal with a variable gap clearance control in a gas turbine engine. A stator vane includes an inner shroud with an inter-stage sealing housing extending inward and separating a front rim cavity from an aft rim cavity. Front and aft rotor disks are located on the sides of the stator vane and include labyrinth seal teeth extending upward to form a seal with an abrasive material supported on the underside of the housing cavity. The abrasive material includes a slanted sealing surface. A hydraulic actuator moves the rotor disks in an axial direction to control the seal gap and regulate the purge air flow into the front rim cavity and leakage flow through the seal into the aft rim cavity. In another embodiment, the sealing surface is stepped as well as slanted.

9 Claims, 3 Drawing Sheets

TURBINE VANE WITH RIM CAVITY SEAL

BACKGROUND OF THE INVENTION

1. Field of the Invention

The present invention relates generally to a gas turbine engine, and more specifically to a stator vane with rim cavity seal.

2. Description of the Related Art Including Information Disclosed Under 37 CFR 1.97 and 1.98

In a gas turbine engine, a compressor provides compressed air into a combustor in which a fuel is burned to produce a hot gas flow. The hot gas flow is passed through a turbine to convert the heat energy from the hot gas flow into mechanical energy that is used to power the compressor and, in the case of an industrial gas turbine (IGT) engine, to drive an electric generator. In a large IGT, efficiency is major priority in order to provide the highest electrical output to fuel cost ratio possible. The turbine includes a number of stages of stator vanes and rotor blades in which rotary seals are used between parts to prevent the hot gas flow from leaking around blade tips or from passing into areas sensitive to high temperatures.

One problem with today's IGT engines is the ability to make improvements to an engine that is difficult to make design changes on. The stator vanes in the turbine section require a seal between the inner shroud portion and the two rotor blades on either sides of the vane. U.S. Pat. No. 6,761,526 B2 issued to Soechting et al on Jul. 13, 2004 and entitled COOLING STRUCTURE OF STATIONARY BLADE, AND GAS TURBINE show (in FIG. 1 of the Seochting patent) a seal formed on the inner end of the vane extending from a seal supporting part that forms the seal with two sealing arms that extend from the rotor disks of the blades on both sides of the vane. Because of thermal growths during engine transients (engine operation during startups and shutdowns) and steady state operations, the seal gap can vary considerably and produce a large opening for leakage across the seal. In this particular situation, the hot gas flow on the left or upstream side of the vane is at a higher pressure and higher temperature than on the downstream or right side of the vane. In order to prevent ingestion of the hot gas flow from the upstream side into the box rim cavity, more cooling air from the vane is required to be pumped into the cavity and is therefore wasted.

In the prior art, passive tip clearance control has been used in aero engines for the reduction of tip leakage control. Cooling air has been used in the cooling of the blade outer seal carrier to minimize the radial thermal expansion. This minimizes the radial tip clearance between the blade and the outer air seal. In addition, high effective cooling schemes were also incorporated into the turbine tip cooling and sealing designs for the reduction of leakage flow across the blade tip. In one prior art engine, the rotor shaft is moved axially by a hydraulic actuator in order to control the rotor blade tip clearance. However, very little progress has been made in the control of rim cavity leakage flow distribution for the reduction of the total purge air demand, especially for a large IGT design application. Due to the large pressure differential between the front rim cavities versus the aft rim cavity, the front rim cavity requires a higher purge air pressure than the aft rim cavity to prevent the hot gas ingestion into the forward cavity. Cooling air for both the forward and the aft rim cavities is provided from the same source, the inter-stage seal housing. An open gap in-between the seal housing versus the rotor will result in purge air being distributed unevenly. A majority of the purge air is passed through the sealing gap and exits from the aft rim cavity. In some cases, hot gas ingestion into the front rim cavity will result from the purge air uneven distribution.

In some IGT engines, the rotor disk cannot withstand exposure to a temperature above 450C because of the thermal properties of the shaft. Higher prolonged temperature exposure due to hot gas flow leakage will result in decreased life of the part from crack growth. Excess cooling air flow to the box rim cavity is required to prevent over-temperature of the shaft. Thus, there is a need in the prior art to improve on the seal capability within the turbine to prevent exposure of certain parts from thermal exposure in order to prolong the useful life of these parts.

BRIEF SUMMARY OF THE INVENTION

It is an object of the present invention to provide for an improved turbine rim cavity seal of the cited prior art references.

It is another object of the present invention to provide for an improved life of turbine rotor shafts by preventing the shaft from over-exposure to high temperatures.

Improvement of the turbine rim cavities purge air flow distribution and minimizing the total leakage flow demand can be achieved by the use of the rim cavity sealing apparatus and process of the present invention. An effective passive seal housing leakage gap control is performed with the use of a hydraulic system for the control of rotor displacement. The bottom surface of the seal housing is built with a thick abrasive material at a slanted angle to the engine centerline. In operation, as the rotor is moved forward by the actuator the gap in-between the sealing housing and the rotor will be reduced. As the rim cavity leakage flow path is reduced, the purge air migration from the forward rim cavity to the aft rim cavity will also be reduced. As a result, the amount of rim cavity purge air required is reduced. In one embodiment of the rim cavity seal, the seal face is slanted. In a second embodiment, the seal face is slanted and stepped.

DETAILED DESCRIPTION OF THE INVENTION

Figure 1:
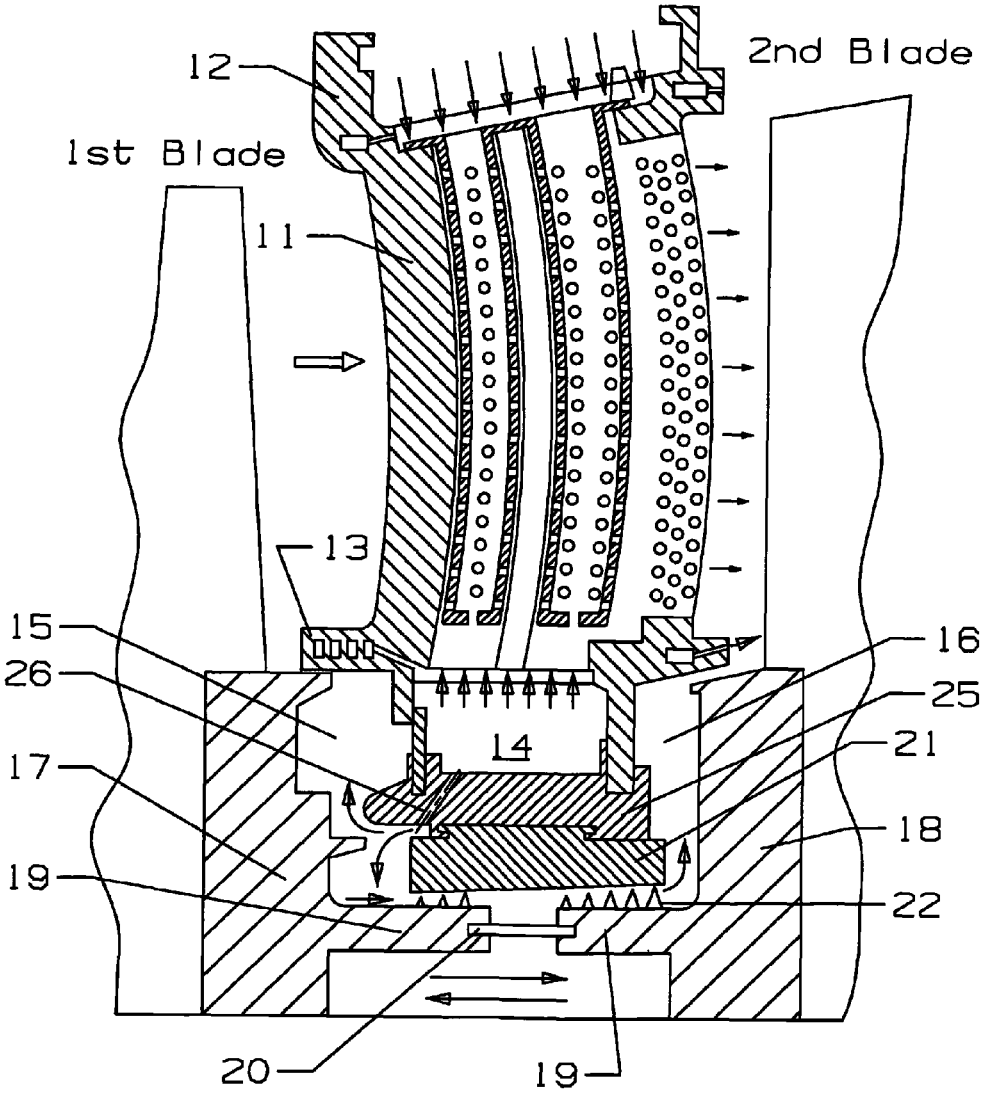
FIG. 1 shows a cross section view of a first embodiment of the present invention.

The turbine rim cavity seal of the present invention is shown in FIG. 1 in which the second stage stator vane 11 is secured to the casing in-between the first stage rotor blade and the second stage rotor blade. The vane includes an outer shroud 12 and an inner shroud 13. The first stage rotor blade disk 17 includes a sealing arm 19 extending afterward. The second stage rotor disk 18 includes a sealing arm extending forward. A seal 20 is placed within the slots of both sealing arms to provide for a seal to close off the box rim cavity. A front rim cavity 15 is formed between the first stage rotor disk 17 and the inter-stage seal housing 14, and an aft rim cavity 16 is formed between the second stage rotor disk 18 and the seal housing 14. A thick abrasive material 21 is secured onto a seal support 25 that extends from the seal housing 14. A plurality of labyrinth seal teeth 22 extend upward from the two sealing arms 19 to form a seal with the abrasive material 21. In the first embodiment, the abrasive material is slanted with the gap increasing in the aft direction. The rim cavity seal of the present invention is described for use in the second stage vanes. However, the rim cavity seal can be used for any stage vane to seal the front and aft rim cavities.

Purge air is supplied through the vane interior to the inter-stage seal housing 14 and used as purge air to flow into the front and the aft rim cavities through the flow path 26 as shown by the arrows. Some of the purge air flows into the front rim cavity 15, and some of the purge air flows through the seal gap and into the aft rim cavity 16. The gap in the seal is regulated by the axial position of the rotor disks. Movement of the rotor shaft toward the aft end (rightward in FIG. 1) would act to shorten the gap and decrease the leakage flow from the front rim cavity 15 to the aft rim cavity 16. Movement of the rotor shaft would act to increase the gap.

Figure 2:
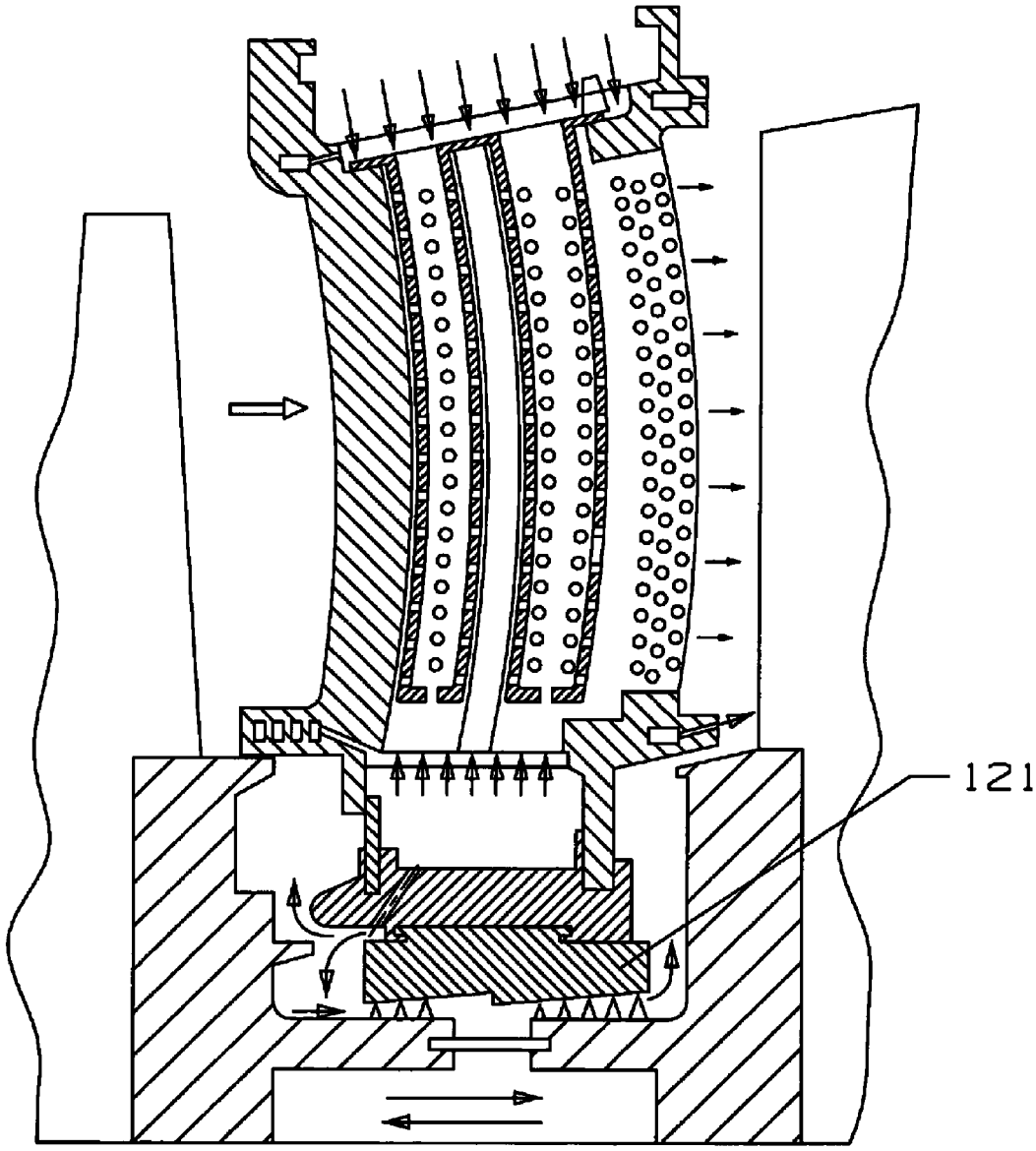
FIG. 2 shows a cross section view of a second embodiment of the present invention.

A second embodiment of the present invention is shown in FIG. 2. The thick abrasive material 121 is the second embodiment is slanted and stepped as seen in FIG. 2. The labyrinth seal teeth extending from the sealing arms form gaps with the two stepped portions on the inner face of the abrasive material 121. Axial movement of the rotor shaft also regulates the gap in the seal.

Figure 3:
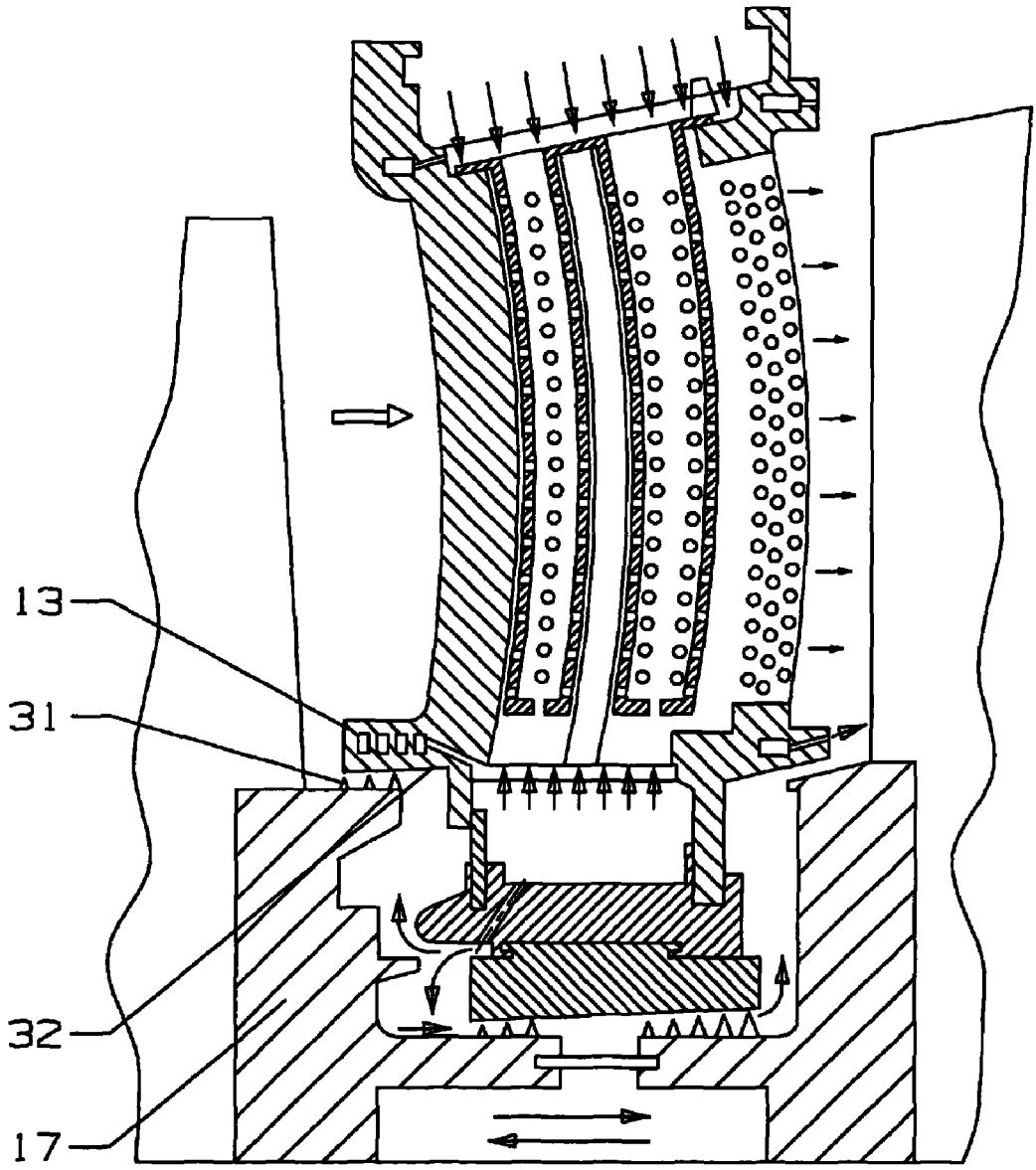
FIG. 3 shows a cross section view of a third embodiment of the present invention.

A third embodiment of the present invention is shown in FIG. 3 and can be used in either of the first two embodiments of FIGS. 1 and 2. The third embodiment of FIG. 3 shows a second slanted labyrinth seal assembly used on the forward section of the inner shroud 13. The inner shroud 13 includes an underside surface 32 slanted to form a seal with a plurality of labyrinth seal teeth 31 extending upward from the rotor disk 17. The slanted surface 32 is slanted such that aft-ward movement of the rotor shaft decreases the gap. The inner shroud labyrinth seal in FIG. 3 can be used in either of the two embodiments shown in FIGS. 1 and 2.

Advantages of the rim cavity leakage control process and apparatus of the present invention is listed below. The bottom surface for all the seal housing is at the conical shape with the expansion angle pointed downstream of the turbine. Expansion angle for each individual seal housing bottom surface need not be at the same angle. The prior art honeycomb seal material or abrasive layer is attached at the bottom surface of the seal housing. The labyrinth seal with a knife edge in the cascade formation is incorporated on the rotor disc to form a sealing path. The rotor disc with the labyrinth seal teeth can be constructed in cascade formation. It depends on the bottom surface sealing design and need not be one single surface construction. The hydraulic actuator is mounted at the end of the engine in front of the engine shaft to push or pull the rotor. Inter-stage housing gap is adjusted manually. The hydraulic actuator can be used to correct the turbine trust balance moment.

The rim cavity seal of the present invention is described for use in the second stage vanes. However, the rim cavity seal can be used for any stage vane to seal the front and aft rim cavities. Also, the seal teeth 22 that extend upward from the sealing arms 19 are described as a cascade formation—the height of the teeth increases such that the teeth tips are spaced a constant distance from the slanted seal surface. However, the sealing arm outer surface can be slanted so that the teeth will have a constant height but the teeth tips will still have the same spacing from the slanted sealing surface.

I claim the following:

1. A gas turbine engine comprising:

a forward rotor disk and an aft rotor disk;

a stator vane extending from the engine casing and positioned between the forward rotor disk and the aft rotor disk;

the stator vane having an inner shroud with a seal forming surface facing inward to form a seal, the seal forming surface being slanted with respect to a rotational axis of the rotor disks;

the forward rotor disk and the aft rotor disk having axial extending portions with outward extending teeth that form the seal with the seal forming surface on the inner shroud of the stator vane; and, means to axially displace the rotor disks such that the seal gap between the slanted seal forming surface the teeth changes.

2. The gas turbine engine of claim 1, and further comprising:

The stator vane includes an inter-stage seal housing extending from the inner shroud of the vane, the inter-stage seal housing forming a front rim cavity with the forward rotor disk and an aft rim cavity with the aft rotor disk;

The slanted seal forming surface is an abradable material secured to an underside of the inter-stage seal housing.

3. The gas turbine engine of claim 2, and further comprising:

a seal support forming a bottom of the inter-stage seal housing chamber;

the abradable material being secured to the seal support; and, a cooling air supply hole connecting the inter-stage seal housing chamber to an upstream location of the rim cavity seal such that cooling air flows into the front rim cavity and through the rim cavity seal.

4. The gas turbine engine of claim 1, and further comprising:

The slanted seal forming surface increases in diameter in the aft direction.

5. The gas turbine engine of claim 1, and further comprising:

The slanted seal forming surface is a two stepped seal forming surface.

6. The gas turbine engine of claim 1, and further comprising:

A forward inner shroud extending from the stator vane and including a slanted underside seal forming surface; and, The forward rotor disk including a seal forming surface with a plurality of upward extending teeth that form a seal between the inner shroud and the forward rotor disk.

7. The gas turbine engine of claim 6, and further comprising:

The seal forming surfaces on the forward inner shroud and on the vane both slant in the same direction such that the two gaps increase or decrease together.

8. The gas turbine engine of claim 7, and further comprising:

An actuator connected to the rotor shaft of the engine to axial displace the rotor disks and change the seal gap.

9. The gas turbine engine of claim 1, and further comprising:

An actuator connected to the rotor shaft of the engine to axial displace the rotor disks and change the seal gap.

* * * * *